US009830889B2

(12) United States Patent
Diard et al.

(10) Patent No.: US 9,830,889 B2
(45) Date of Patent: Nov. 28, 2017

(54) METHODS AND SYSTEM FOR ARTIFICALLY AND DYNAMICALLY LIMITING THE DISPLAY RESOLUTION OF AN APPLICATION

(75) Inventors: Franck Diard, Mountain View, CA (US); Ganesh Kadaba, Cupertino, CA (US)

(73) Assignee: Nvidia Corporation, Santa Clara, CA (US)

( * ) Notice: Subject to any disclaimer, the term of this patent is extended or adjusted under 35 U.S.C. 154(b) by 689 days.

(21) Appl. No.: 12/651,177

(22) Filed: Dec. 31, 2009

(65) Prior Publication Data

US 2011/0157181 A1 Jun. 30, 2011

(51) Int. Cl.

| | |
|---|---|
| ***G09G 5/39*** | (2006.01) |
| ***G09G 5/393*** | (2006.01) |
| *G09G 5/391* | (2006.01) |

(52) U.S. Cl.

CPC ..... *G09G 5/393* (2013.01); *G09G 5/391* (2013.01); *G09G 2340/0407* (2013.01); *G09G 2360/02* (2013.01); *G09G 2360/121* (2013.01)

(58) Field of Classification Search

CPC ..... G06T 3/40; G09G 2340/0407

See application file for complete search history.

(56) References Cited

U.S. PATENT DOCUMENTS

| | | | |
|---|---|---|---|
| 4,335,445 | A | 6/1982 | Nercessian |
| 4,544,910 | A | 10/1985 | Haberman |
| 4,679,130 | A | 7/1987 | Moscovici |
| 4,706,180 | A | 11/1987 | Wills |
| 4,739,252 | A | 4/1988 | Malaviya et al. |

(Continued)

FOREIGN PATENT DOCUMENTS

| | | |
|---|---|---|
| EP | 0381021 | 8/1990 |
| EP | 0474963 | 3/1992 |

(Continued)

OTHER PUBLICATIONS

NVIDIA Corporation, "NVIDIA Accelerated Linux Graphics Driver README and Installation Guide," (2006).*

(Continued)

*Primary Examiner* — Zhengxi Liu

(57) ABSTRACT

Embodiments of the present invention are directed to provide a method and system for automatically applying artificial limits to display resolutions in a computing system to improve performance. Embodiments are described herein that automatically limits the display resolution of an application executing in a discrete graphics processing unit operating from configurations with limited means of data transfer to the system memory. By automatically limiting the resolution in certain detected circumstances, the rate of generated graphics data may be dramatically increased. Another embodiment is also provided which allows for the automatic detection of an application's initialization and pro-actively limiting the user-selectable resolutions in which the output of the application may be displayed in to a maximum resolution calculated for optimal performance. The application's termination is also detected, whereupon a comprehensive list of supported resolutions becomes available.

17 Claims, 4 Drawing Sheets

(56) References Cited

U.S. PATENT DOCUMENTS 4,868,832 A 9/1989 Marrington et al.
4,893,228 A 1/1990 Orrick et al.
5,086,501 A 2/1992 Deluca et al.
5,103,110 A 4/1992 Housworth et al.
5,167,024 A 11/1992 Smith et al.
5,177,431 A 1/1993 Smith et al.
5,201,059 A 4/1993 Nguyen
5,204,863 A 4/1993 Saint-Joigny et al.
5,218,704 A 6/1993 Watts, Jr. et al.
5,218,705 A 6/1993 DeLuca et al.
5,230,055 A 7/1993 Katz et al.
5,239,652 A 8/1993 Seibert et al.
5,254,878 A 10/1993 Olsen
5,300,831 A 4/1994 Pham et al.
5,307,003 A 4/1994 Fairbanks et al.
5,337,254 A 8/1994 Knee et al.
5,339,445 A 8/1994 Gasztonyi
5,350,988 A 9/1994 Le
5,396,443 A 3/1995 Mese et al.
5,410,278 A 4/1995 Itoh et al.
5,422,806 A 6/1995 Chen et al.
5,440,520 A 8/1995 Schutz et al.
5,446,365 A 8/1995 Nomura et al.
5,461,266 A 10/1995 Koreeda et al.
5,502,838 A 3/1996 Kikinis
5,511,203 A 4/1996 Wisor et al.
5,513,152 A 4/1996 Cabaniss
5,560,020 A 9/1996 Nakatani et al.
5,561,692 A 10/1996 Maitland et al.
5,568,103 A 10/1996 Nakashima et al.
5,568,350 A 10/1996 Brown
5,583,875 A 12/1996 Weiss
5,586,308 A 12/1996 Hawkins et al.
5,587,672 A 12/1996 Ranganathan et al.
5,589,762 A 12/1996 Iannuzo
5,590,342 A 12/1996 Marisetty
5,592,173 A 1/1997 Lau et al.
5,594,360 A 1/1997 Wojciechowski
5,630,110 A 5/1997 Mote, Jr.
5,648,766 A 7/1997 Stengel et al.
5,666,522 A 9/1997 Klein
5,675,272 A 10/1997 Chu
5,680,359 A 10/1997 Jeong
5,682,093 A 10/1997 Kivela
5,692,204 A 11/1997 Rawson et al.
5,710,929 A 1/1998 Fung
5,717,319 A 2/1998 Jokinen
5,719,800 A 2/1998 Mittal et al.
5,727,208 A 3/1998 Brown
5,737,613 A 4/1998 Mensch, Jr.
5,742,142 A 4/1998 Witt
5,742,607 A 4/1998 Beighe et al.
5,745,375 A 4/1998 Reinhardt et al.
5,752,011 A 5/1998 Thomas et al.
5,754,869 A 5/1998 Holzhammer et al.
5,757,171 A 5/1998 Babcock
5,757,172 A 5/1998 Hunsdorf et al.
5,760,636 A 6/1998 Noble et al.
5,764,110 A 6/1998 Ishibashi
5,774,703 A 6/1998 Weiss et al.
5,774,704 A 6/1998 Williams
5,778,237 A 7/1998 Yamamoto et al.
5,787,011 A 7/1998 Ko
5,796,313 A 8/1998 Eitan
5,812,860 A 9/1998 Harden et al.
5,815,724 A 9/1998 Mates
5,825,674 A 10/1998 Jackson
5,825,972 A 10/1998 Brown
5,847,552 A 12/1998 Brown
5,848,281 A 12/1998 Smalley et al.
5,864,225 A 1/1999 Bryson
5,884,049 A 3/1999 Atkinson
5,884,068 A 3/1999 Canary et al.
5,894,577 A 4/1999 MacDonald et al.
5,913,067 A 6/1999 Klein
5,923,545 A 7/1999 Nguyen
5,926,394 A 7/1999 Nguyen et al.
5,933,649 A 8/1999 Lim et al.
5,940,785 A 8/1999 Georgiou et al.
5,940,786 A 8/1999 Steeby
5,952,798 A 9/1999 Jones et al.
5,974,557 A 10/1999 Thomas et al.
5,977,763 A 11/1999 Loughmiller et al.
5,978,926 A 11/1999 Ries et al.
5,991,883 A 11/1999 Atkinson
5,996,083 A 11/1999 Gupta et al.
5,996,084 A 11/1999 Walls
6,002,409 A 12/1999 Harkin
6,005,904 A 12/1999 Knapp et al.
6,011,403 A 1/2000 Gillette
6,023,776 A 2/2000 Ozaki
6,025,737 A 2/2000 Patel et al.
6,035,357 A 3/2000 Sakaki
6,035,407 A 3/2000 Gebara et al.
6,040,668 A 3/2000 Huynh et al.
6,047,248 A 4/2000 Georgiou et al.
6,065,126 A 5/2000 Tran et al.
6,065,131 A 5/2000 Andrews et al.
6,076,171 A 6/2000 Kawata
6,124,732 A 9/2000 Zilic et al.
6,134,167 A 10/2000 Atkinson
6,141,762 A 10/2000 Nicol et al.
6,163,583 A 12/2000 Lin et al.
6,167,524 A 12/2000 Goodnow et al.
6,167,529 A 12/2000 Dalvi
6,172,943 B1 1/2001 Yuzuki
6,208,350 B1 3/2001 Herrera
6,212,645 B1 4/2001 Tjandrasuwita
6,216,234 B1 4/2001 Sager et al.
6,219,795 B1 4/2001 Klein
6,229,747 B1 5/2001 Cho et al.
6,242,936 B1 6/2001 Ho et al.
6,243,656 B1 6/2001 Arai et al.
6,255,974 B1 7/2001 Morizio et al.
6,289,396 B1 9/2001 Keller et al.
6,304,824 B1 10/2001 Bausch et al.
6,310,912 B1 10/2001 Maiocchi et al.
6,311,287 B1 10/2001 Dischler et al.
6,323,875 B1 11/2001 Millman et al.
6,337,717 B1 1/2002 Nason et al.
6,360,327 B1 3/2002 Hobson
6,363,490 B1 3/2002 Senyk
6,366,157 B1 4/2002 Abdesselem et al.
6,369,557 B1 4/2002 Agiman
6,407,571 B1 6/2002 Furuya et al.
6,411,302 B1 6/2002 Chiraz
6,415,388 B1 7/2002 Browning et al.
6,422,746 B1 7/2002 Weiss et al.
6,425,086 B1 7/2002 Clark et al.
6,426,641 B1 7/2002 Koch et al.
6,448,815 B1 9/2002 Talbot et al.
6,456,049 B2 9/2002 Tsuji
6,457,134 B1 9/2002 Lemke et al.
6,470,289 B1 10/2002 Peters et al.
6,476,632 B1 11/2002 La Rosa et al.
6,484,041 B1 11/2002 Aho et al.
6,489,796 B2 12/2002 Tomishima
6,510,525 B1 1/2003 Nookala et al.
6,535,424 B2 3/2003 Le et al.
6,535,986 B1 3/2003 Rosno et al.
6,549,243 B1 4/2003 Takashimizu et al.
6,549,802 B2 4/2003 Thornton
6,574,739 B1 6/2003 Kung et al.
6,600,575 B1 7/2003 Kohara
6,621,242 B2 9/2003 Huang et al.
6,630,754 B1 10/2003 Pippin
6,636,976 B1 10/2003 Grochowski et al.
6,650,074 B1 11/2003 Vyssotski et al.
6,650,740 B1 11/2003 Adamczyk et al.
6,657,504 B1 12/2003 Deal et al.
6,662,775 B2 12/2003 Hauser
6,665,802 B1 12/2003 Ober
6,668,346 B1 12/2003 Schulz et al.
6,674,587 B2 1/2004 Chhabra et al.

(56) References Cited

U.S. PATENT DOCUMENTS 6,677,964 B1 1/2004 Nason et al.
6,678,831 B1 1/2004 Mustafa et al.
6,690,219 B2 2/2004 Chuang
6,691,236 B1 2/2004 Atkinson
6,703,803 B2 3/2004 Ohiwa et al.
6,714,891 B2 3/2004 Dendinger
6,718,496 B1 4/2004 Fukuhisa et al.
6,721,892 B1 4/2004 Osborn et al.
6,737,860 B2 5/2004 Hsu et al.
6,745,385 B1 6/2004 Lupu et al.
6,748,408 B1 6/2004 Bredin et al.
6,768,659 B2 7/2004 Gillingham et al.
6,774,587 B2 8/2004 Makaran et al.
6,792,379 B2 9/2004 Ando
6,794,836 B2 9/2004 Strothmann et al.
6,795,075 B1 9/2004 Streitenberger et al.
6,795,927 B1 9/2004 Altmejd et al.
6,799,134 B2 9/2004 Borchers et al.
6,801,004 B2 10/2004 Frankel et al.
6,804,131 B2 10/2004 Galbiati et al.
6,806,673 B2 10/2004 Ho
6,815,938 B2 11/2004 Horimoto
6,815,971 B2 11/2004 Wang et al.
6,831,448 B2 12/2004 Ishii et al.
6,836,849 B2 12/2004 Brock et al.
6,837,063 B1 1/2005 Hood, III et al.
6,853,259 B2 2/2005 Norman et al.
6,853,569 B2 2/2005 Cheng et al.
6,885,233 B2 4/2005 Huard et al.
6,889,331 B2 5/2005 Soerensen et al.
6,889,332 B2 5/2005 Helms et al.
6,907,535 B2 6/2005 Fang
6,910,139 B2 6/2005 Ishidera
6,914,492 B2 7/2005 Hui et al.
6,938,176 B1 8/2005 Alben et al.
6,947,865 B1 9/2005 Mimberg et al.
6,970,798 B1 11/2005 Cao et al.
6,975,087 B1 12/2005 Grabill et al.
6,976,112 B2 12/2005 Franke et al.
6,987,370 B2 1/2006 Chheda et al.
6,990,594 B2 1/2006 Kim
7,003,421 B1 2/2006 Allen, III et al.
7,005,894 B2 2/2006 Weder
7,042,296 B2 5/2006 Hui et al.
7,043,649 B2 5/2006 Terrell, II
7,045,993 B1 5/2006 Tomiyoshi
7,051,215 B2 5/2006 Zimmer et al.
7,068,557 B2 6/2006 Norman et al.
7,071,640 B2 7/2006 Kurosawa et al.
7,100,013 B1 8/2006 de Waal
7,100,061 B2 8/2006 Halepete et al.
7,112,978 B1 9/2006 Koniaris et al.
7,119,522 B1 10/2006 Tomiyoshi
7,122,978 B2 10/2006 Nakanishi et al.
7,129,745 B2 10/2006 Lewis et al.
7,149,909 B2 12/2006 Cui et al.
7,180,322 B1 2/2007 Koniaris et al.
7,256,571 B1 8/2007 Mimberg et al.
7,256,788 B1 8/2007 Luu et al.
7,334,198 B2 2/2008 Ditzel et al.
7,336,090 B1 2/2008 Koniaris et al.
7,336,092 B1 2/2008 Koniaris et al.
7,348,827 B2 3/2008 Rahim et al.
7,348,836 B1 3/2008 Velmurugan
7,363,176 B2 4/2008 Patel et al.
7,409,570 B2 8/2008 Suzuoki
7,414,450 B2 8/2008 Luo et al.
7,490,256 B2 2/2009 Marshall et al.
7,509,504 B1 3/2009 Koniaris et al.
7,574,613 B2 8/2009 Holle et al.
7,598,953 B2 10/2009 Tarditi, Jr. et al.
7,634,668 B2 12/2009 White et al.
7,698,579 B2 4/2010 Hendry et al.
7,725,749 B2 5/2010 Mitarai
7,739,531 B1 6/2010 Krishnan
7,849,332 B1 12/2010 Alben et al.
7,882,369 B1 2/2011 Kelleher et al.
7,886,164 B1 2/2011 Alben et al.
8,370,663 B2 2/2013 Frid et al.
8,762,761 B2 6/2014 Zheng et al.
8,775,843 B2 7/2014 Frid et al.
8,839,006 B2 9/2014 Li et al.
8,839,066 B2 9/2014 Li et al.
9,256,265 B2 2/2016 Huang et al.
2001/0033504 A1 10/2001 Galbiati et al.
2001/0040584 A1* 11/2001 Deleeuw ..... 345/629
2001/0044909 A1 11/2001 Oh et al.
2001/0045779 A1 11/2001 Lee et al.
2002/0002689 A1 1/2002 Yeh
2002/0004912 A1 1/2002 Fung
2002/0026597 A1 2/2002 Dai et al.
2002/0029352 A1 3/2002 Borkar et al.
2002/0029374 A1 3/2002 Moore
2002/0032829 A1 3/2002 Dalrymple
2002/0049920 A1 4/2002 Staiger
2002/0067429 A1 6/2002 Nason et al.
2002/0073348 A1 6/2002 Tani
2002/0083356 A1 6/2002 Dai
2002/0085033 A1* 7/2002 Robinson et al. ..... 345/762
2002/0087896 A1 7/2002 Cline et al.
2002/0099964 A1 7/2002 Zdravkovic
2002/0101257 A1 8/2002 Kawahara et al.
2002/0113622 A1 8/2002 Tang
2002/0116650 A1 8/2002 Halepete et al.
2002/0138778 A1 9/2002 Cole et al.
2002/0154214 A1 10/2002 Scallie et al.
2002/0178390 A1 11/2002 Lee
2002/0194509 A1 12/2002 Plante et al.
2003/0014561 A1 1/2003 Cooper
2003/0036876 A1 2/2003 Fuller, III et al.
2003/0065960 A1 4/2003 Rusu et al.
2003/0074591 A1 4/2003 McClendon et al.
2003/0079151 A1 4/2003 Bohrer et al.
2003/0110423 A1 6/2003 Helms et al.
2003/0131147 A1 7/2003 Wilt et al.
2003/0133621 A1 7/2003 Fujii et al.
2003/0140179 A1 7/2003 Wilt et al.
2003/0189465 A1 10/2003 Abadeer et al.
2003/0210271 A1 11/2003 King
2004/0025061 A1 2/2004 Lawrence
2004/0032414 A1 2/2004 Jain et al.
2004/0032423 A1 2/2004 Nason et al.
2004/0073821 A1 4/2004 Naveh et al.
2004/0105237 A1 6/2004 Hoover et al.
2004/0105327 A1 6/2004 Tanno
2004/0123170 A1 6/2004 Tschanz et al.
2004/0123172 A1 6/2004 Sheller
2004/0128631 A1 7/2004 Ditzel et al.
2004/0177338 A1 9/2004 Fathalla
2004/0215779 A1 10/2004 Weber
2004/0231000 A1 11/2004 Gossalia et al.
2005/0007047 A1 1/2005 Strothmann et al.
2005/0012749 A1 1/2005 Gonzalez et al.
2005/0071705 A1 3/2005 Bruno et al.
2005/0149947 A1 7/2005 Callender
2005/0172079 A1* 8/2005 McFarling ..... 711/133
2005/0218871 A1 10/2005 Kang et al.
2005/0268141 A1 12/2005 Alben et al.
2005/0268189 A1 12/2005 Soltis
2005/0268301 A1* 12/2005 Kelley et al. ..... 718/100
2005/0289367 A1 12/2005 Clark et al.
2006/0074576 A1 4/2006 Patel et al.
2006/0075119 A1* 4/2006 Hussain et al. ..... 709/227
2006/0109266 A1 5/2006 Itkowitz et al.
2006/0174277 A1* 8/2006 Sezan ..... H04N 7/163
725/46
2006/0290700 A1 12/2006 Gonzalez et al.
2007/0094413 A1 4/2007 Salazar et al.
2007/0126749 A1 6/2007 Tzruya et al.
2007/0129990 A1 6/2007 Tzruya et al.
2007/0171222 A1 7/2007 Kowalski
2007/0179940 A1* 8/2007 Robinson et al. ..... 707/4
2007/0220289 A1 9/2007 Holle et al.
2007/0229054 A1 10/2007 Dobberpuhl et al.

(56) References Cited

U.S. PATENT DOCUMENTS

| | | | | |
|---|---|---|---|---|
| 2007/0234088 | A1 | 10/2007 | Marshall et al. | |
| 2007/0257710 | A1 | 11/2007 | Mari et al. | |
| 2007/0283175 | A1 | 12/2007 | Marinkovic et al. | |
| 2007/0296440 | A1 | 12/2007 | Takamiya et al. | |
| 2008/0012792 | A1 | 1/2008 | Li et al. | |
| 2008/0042923 | A1 | 2/2008 | De Laet | |
| 2008/0109795 | A1* | 5/2008 | Buck et al. | 717/137 |
| 2008/0136825 | A1 | 6/2008 | Bakalash et al. | |
| 2008/0143372 | A1 | 6/2008 | Koniaris et al. | |
| 2008/0163263 | A1 | 7/2008 | Li et al. | |
| 2008/0168479 | A1 | 7/2008 | Purtell et al. | |
| 2008/0211816 | A1 | 9/2008 | Gonzalez et al. | |
| 2008/0316218 | A1 | 12/2008 | Kilani et al. | |
| 2009/0072885 | A1 | 3/2009 | Kawasaki | |
| 2009/0153540 | A1 | 6/2009 | Blinzer et al. | |
| 2009/0172707 | A1 | 7/2009 | Huang et al. | |
| 2009/0307699 | A1 | 12/2009 | Munshi et al. | |
| 2010/0216524 | A1 | 8/2010 | Thomas et al. | |
| 2010/0302261 | A1 | 12/2010 | Abdo et al. | |
| 2010/0318828 | A1 | 12/2010 | Elting et al. | |
| 2011/0074800 | A1* | 3/2011 | Stevens et al. | 345/545 |
| 2011/0264946 | A1 | 10/2011 | Goodemote et al. | |
| 2011/0283130 | A1 | 11/2011 | Pai et al. | |
| 2012/0102344 | A1 | 4/2012 | Kocev et al. | |

FOREIGN PATENT DOCUMENTS

| | | |
|---|---|---|
| EP | 0501655 | 9/1992 |
| EP | 0632360 | 1/1995 |
| EP | 0794481 | 7/1997 |
| EP | 0978781 | 2/2000 |
| EP | 0991191 | 4/2000 |
| EP | 1096360 | 5/2001 |
| EP | 1182538 | 2/2002 |
| EP | 1182556 | 2/2002 |
| EP | 1398639 | 3/2004 |
| GB | 2342471 | 4/2000 |
| GB | 2393540 | 3/2004 |
| GB | 2404792 | 2/2005 |
| JP | H07129277 | 5/1995 |
| JP | 409185589 | 7/1997 |
| JP | 10187300 | 7/1998 |
| JP | 2000284862 | 10/2000 |
| JP | 3076234 | 3/2001 |
| JP | 2003122459 | 4/2003 |
| JP | 2003195981 | 7/2003 |
| WO | 0127728 | 4/2001 |
| WO | 03079171 | 9/2003 |

OTHER PUBLICATIONS

NVIDIA Corporation, "ForceWare Graphics Drivers, Release 90 Notes, Version 93.71," (2006).*

"Want to auto-change screen resolution application by application" posted on Jun. 6, 2005, retrieved on Oct. 7, 2012 from http://www.tomshardware.com/forum/35901-45-want-auto-change-screen-resolution-application-appli.*

Renato M. Okamoto, Flávio L. de Mello, and Claudio Esperança. 2008. Texture management in view dependent application for large 3D terrain visualization. In Proceedings of the 2008 Spring simulation multiconference (SpringSim '08). Society for Computer Simulation International, San Diego, CA, USA, 641-647.*

"Video Memory (Frame Buffer)" http://www.pcguide.com/ref/video/overMemory-c.html. Archived on Feb 3, 2002. Retrieved on Feb 5, 2014 from <https://web.archive.org/web/20000901235400/http://www.pcguide.com/ref/video/overMemory-c.html>.*

Lorch, J.R. et al.: Software Strategies for Portable Computer Energy Management: IEEE Personal Communications, IEEE, Communications Society, US vol. 5, No. 3 Jun. 1, 1997, pp. 60-73, XP000765376 ISSN: 1070-9916 the whole locument.

Melear, C.: Hardware and Software Techniques for Power Conservation in Portable Devices: Wescon Conference IEEE Center, Hoes Lane, US Sep. 27, 1994, pp. 453-461, XP0000532610 ISSN: 1044-6036, the whole document.

Dubois, Y.A. et al.: ASIC Design Considerations for Power Management in Laptop Computers: Euro ASIC 91 Paris, France May 27-31, 1991, Los Alamitos, CA USA, IEEE Comput. Soc. US, pp. 348-351, XP010024394 ISBN: Mar. 8186-2185-0, the whole document.

Young, R. et al: "Adaptive Clock Speed Control for Variable Processor Loading" Motorola Technical Developments, Motorola Inc. Schaumburg, IL, US, vol. 15, May 1, 1992, pp. 43-44, XP000306138, ISSN: 0887-5286, the whole locument.

"Computer Software", Wikipedia, http://en.wikipedia.org/wiki/software, retrieved May 2, 2007.

"High Speed, Digitally Adjusted Stepdown Controllers for Notebook CPUS", Maxim Manual, pp. 11& 21.

Alben, et al.; A Processor Speed Adjustment System and Method; U.S. Appl. No. 10/449,942, filed May 30, 2003.

Alben, et al.; A Processor Voltage Adjustment System and Method; U.S. Appl. No. 101448,891, filed May 30, 2003.

Baker, K. et al.; "Wafer Burn-In Isolation Circuit" IBM Technical Disclosure Bulletin, IBM Corp., New York, US, vol. 32, No. 6B, Nov. 1, 1989, pp. 442-443, XP00073858 ISSN: 0018-8689.

Baker, K. et al.; 'Shmoo Plotting: The Black Art of IC Testing, IEEE Design and Test of Computers, IEEE vol. 14, No. 3; Jul. 1, 1997; pp. 90-97; XP000793305 ISSNL 0740-7475.

Calavert, J.B., "The Phase-Locked Loop", Jul. 24, 2001, http://www.du.edut/.about.etuttle/electron/elect12.htm.

Grishman, Ralph; Lecture Notes, "Computer System Design-Spring 2002", "Lecture 2: Combinational Logic Design", 2002, Department of Computer Science, New York University.

Operation U (Refer to Functional Diagram), LTC 1736 Linear Technology Manual, p. 9.

Kelleher, et al.; A Processor Performance Adjustment System and Method; U.S. Appl. No. 10/295,619, filed Nov. 14, 2002.

Laplante, P. Comprehensive Dictionary of Electrical Engineering, CRC Press, IEEE Press, pp. 164-165.

Microchip Technology Inc., Linear Voltage Fan Speed Control Using Microchips TC64X Family, pp. 1-4, 2003.

Migdal, et al.; "A Processor Temperature and ODE Adjustment System and Method", U.S. Appl. No. 10/295,748, filed Nov. 14, 2002.

Oner, H et al.; "A Compact Monitoring Circuit for Real-Time-On-Chip Diagnosis of Hot-Carrier Induced Degradation". Microelectronics Test Structures, 1997. ICMTS 1997. Proceedings, IEEE International Conference on Monterey, CA May 17, 1993-May 20, 1997, pp. 72-76.

Govil, K. et al.; "Comparing Algorithms for Dynamic Speed-Setting of a Low-Power PCU"; International Computer Science Institute; Berkeley, CA; Apr. 1995.

Mobile Pentium.RTM. III Processors-Thermal Management, http://supportintel.com/support/processors/mobile/pentiumiii/thermal.htm- , Sep. 12, 2002, pp. 1-4.

Hong, I. et al.; Power Optimization of Variable Voltag Core Based Systems; Jun. 1998; Design Automation Conference Proceedings.

Hong, I. et al.; Synthesis Techniques for Low-Power Hard Real-Time Systems on Variable Voltage Processors; Real-Time System Symposium Proceedings. Dec. 1998.

Intel, Intel Pentium 4 Processor in the 423-pin Package, pp. 78-80, (Date believed prior to Nov. 14, 2002).

Mobile Pentium.RTM. III Processors-Thermal Diode, http://support.intel.com/support/processors/mobile/pentiumiii/diode.htm, Sep. 12, 2002, pp. 1-2.

Mobile Pentium.RTM. III Processors-Enhanced Intel.RTM. SpeedStep.TM. Technology, http://support.intel.com/support/processors/mobile/pentiumiii/tti004.htm, Sep. 12, 2002, pp. 1-4.

* cited by examiner

Exemplary Computer
System 400

METHODS AND SYSTEM FOR ARTIFICALLY AND DYNAMICALLY LIMITING THE DISPLAY RESOLUTION OF AN APPLICATION

BACKGROUND

A graphics processing unit or "GPU" is a device used to perform graphics rendering operations in modern computing systems such as desktops, notebooks, and video game consoles, etc. Traditionally, graphics processing units are typically implemented as either integrated units or within discrete video cards.

Integrated graphics processing units are graphics processors that utilize a portion of a computer's system memory rather than having its own dedicated memory. Due to this arrangement, integrated GPUs (or "iGPUs") are typically localized in close proximity to, if not disposed directly upon, some portion of the main circuit board (e.g., a motherboard) of the computing system. Integrated GPUs are, in general, cheaper to implement than discrete GPUs, but are typically lower in capability and operate at reduced performance levels relative to discrete GPUs.

Discrete or "dedicated" GPUs (or "dGPUs") are distinguishable from integrated GPUs by having local memory dedicated for use by the GPU which they do not share with the underlying computer system. Commonly, discrete GPUs are implemented on discrete circuit boards called "video cards" which include, among other components, a GPU, local memory units, an interface with one or more communication buses and various output terminals. These video cards typically interface with the main circuit board of a computing system through an interface of a standardized expansion slot such as PCI Express (PCI-e) or Accelerated Graphics Port (AGP), upon which the video card may be mounted. In general, discrete GPUs are capable of significantly higher performance levels relative to integrated GPUs. However, discrete GPUs also typically require their own separate power inputs, and require higher capacity power supply units to function properly. Consequently, discrete GPUs also have higher rates of power consumption relative to integrated graphics solutions.

Some modern main circuit boards often include an integrated graphics processing unit as well as one or more additional expansion slots available to add a dedicated graphics unit. Each GPU can and typically does have its own output terminals with one or more ports corresponding to one or more audio/visual standards (e.g., VGA, HDMI, DVI, etc.), though typically only one of the GPUs will be running in the computing system at any one time. Alternatively, other modern computing systems can include a main circuit board capable of simultaneously utilizing two identical dedicated graphics units to generate output for one or more displays.

Some notebook and laptop computers have been manufactured to include two or more graphics processors. Notebook and laptop computers with more than one graphics processing units are almost invariably solutions featuring an integrated GPU and a discrete GPU. Portable computing devices with both integrated and discrete graphics processing solutions often offer a mechanism or procedure that enables the user to alternate usage between the particular solutions so as to manage performance and battery life according to situational needs or desired performance levels. Recently, the PCI Express expansion slot interface has become a dominant interface standard through which discrete GPUs are coupled to the main circuit boards of mobile computing devices. However, unlike PCI-e interfaces in other computing systems such as desktops, the PCI-e interface of a portable computing device is often of a reduced size and, naturally, of a reduced capacity. In a typical configuration, the PCI-e interface of any computing device comprises a plurality of links, with each link comprising a further plurality of "lanes," and with each link being configured to independently couple to a peripheral device. The number of lanes in a link coupled to a peripheral device correlates with the bandwidth of the connection, and thus, couplings between a peripheral device and a link with larger amounts of lanes have greater bandwidth than couplings with links comprised of only single lanes. Traditionally, the number of links in a PCI-e interface of a portable computing device may be configured by the manufacturer in separate configurations to suit specific hardware implementations.

In a popular configuration, the links in a PCI-e interface of a portable computing device may be arranged in either of two combinations totaling up to four lanes. For example, implementations can comprise either a single link of four lanes (1×4), thereby offering relatively greater bandwidth for a coupled device. Alternatively, implementations may feature four separate links, with each link capable of being coupled to a separate device but limited to a single lane (4×1) with a correspondingly low bandwidth. Thus, whenever the PCI-e interface is coupled to one device, the single link (1×4) configuration may be optimal, but multiple devices require additional links that adversely impact the amount of bandwidth and throughput of each connection.

Unfortunately, since netbooks and laptops are often intended to be used with network connections, chipset manufacturers of computing devices that will include a discrete GPU will invariably manufacture circuit boards with PCI-e interfaces having four separate links of one lane each, one of which is occupied by a network controller (e.g., a network interface card). This results in the extremely inefficient configuration wherein only one link is coupled to the graphics processing unit, another link is coupled to the network controller, and the other two links remain unoccupied (or coupled to additional devices). While the bandwidth from a link with only one lane may be sufficient to run certain applications on certain devices, for usage in graphics processing a link having only a single lane is often insufficient and likely to drastically and adversely impact the performance of the discrete graphics processing unit.

According to typical graphics rendering processes, single units of images displayed to a user during a graphical sequence (e.g., a video) during the execution of an application are arranged as frames. Each frame is produced by sending graphics rendering instructions from the executing application to a GPU for rendering. Once a frame has completed rendering, the GPU will store the completed frame in one or more frame buffers. Generally, the size of a GPU's frame buffers is static and comprised in the local memory of the GPU. However, the size of the data contained in a rendered frame can often vary widely between applications. In general, higher resolutions are preferable for many applications. Higher resolutions also increase the size of the rendered frames. This may not be a concern when the application produces relatively simple graphical output (e.g., typical word processing applications). However, 3D gaming applications are generally graphically intensive and, when displayed at a sufficiently high resolution, a rendered frame may be large enough such that the remaining space available in the frame buffer may not be sufficient to store additional graphics resources (e.g., textures).

Typically, when the size of a rendered frame consumes a large amount of space in the frame buffer, those additional graphics resources may be stored in the system memory. The extra data is communicated (e.g., copied) to the system memory through the coupling communication bus (typically, the PCI-e bus). However, when the bandwidth of the PCI-e interface is limited, as in single lane link architectures, due to the limited speed of data transfer rates, transferring the data between the memory of the GPU and system memory when accessing the graphics resources will add considerably to the duration of the graphics rendering process. This can adversely affect the user's graphical experience by creating significant delays and severely crippling the rate at which scenes or images may be displayed to the user (e.g., the application's "frame rate"). In 3D gaming applications which can be extremely time sensitive, even slight delays can be a nuisance, with significant delays potentially becoming a significant problem.

SUMMARY

Embodiments of the present invention are directed to provide a method and system for automatically applying artificial limits to display resolutions in a computing system to improve performance. Embodiments are described herein that automatically limits the display resolution of an application executing in a discrete graphics processing unit operating from configurations with limited means of data transfer to the system memory. By automatically limiting the resolution in certain detected circumstances, the rate of generated graphics data may be dramatically increased. Another embodiment is also provided which allows for the automatic detection of an application's initialization and pro-actively limiting the user-selectable resolutions in which the output of the application may be displayed in to a maximum resolution calculated for optimal performance. The application's termination is also detected, whereupon a comprehensive list of supported resolutions becomes available.

One novel embodiment receives a list of display settings optimized for generating output from the application in the GPU of the current operating GPU in the system. The display settings are cached in the display driver of the display device and a display re-enumeration is forced through the operating system of the computing device, whereupon the pre-determined list of display settings is substituted for the original, more comprehensive list. Subsequently, the output generated by the GPU for the application and displayed in the display device will be displayed according to one set of settings in the pre-determined list of settings. In some embodiments, the user is prompted to select from the pre-determined list of settings. In alternate embodiments, the highest setting is automatically selected without user interaction.

Another embodiment monitors the initialization of an application in a computing system. Once an application's initialization is detected, a profile corresponding to the application is referenced to determine the memory usage requirements of the application. The memory of the current operating GPU is queried to determine the size of the frame buffer, and an optimal display resolution is calculated based on the memory usage and the size of the frame buffer. Output generated by the GPU for the application is subsequently displayed according to the optimal resolution. Once the application terminates, a full list of supported display resolutions in which graphical output may be generated is enabled.

Each of the above described novel methods and system feature the ability to provide improved graphical performance in situations where the size of a frame buffer may be inadequate to support extreme graphical resolutions and data transfer rates may be limited. In short, a system's graphical performance is more optimally and automatically configured based on prevailing circumstances.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to several embodiments. While the subject matter will be described in conjunction with the alternative embodiments, it will be understood that they are not intended to limit the claimed subject matter to these embodiments. On the contrary, the claimed subject matter is intended to cover alternative, modifications, and equivalents, which may be included within the spirit and scope of the claimed subject matter as defined by the appended claims.

Furthermore, in the following detailed description, numerous specific details are set forth in order to provide a thorough understanding of the claimed subject matter. However, it will be recognized by one skilled in the art that embodiments may be practiced without these specific details or with equivalents thereof. In other instances, well-known processes, procedures, components, and circuits have not been described in detail as not to unnecessarily obscure aspects and features of the subject matter.

Figure 1:
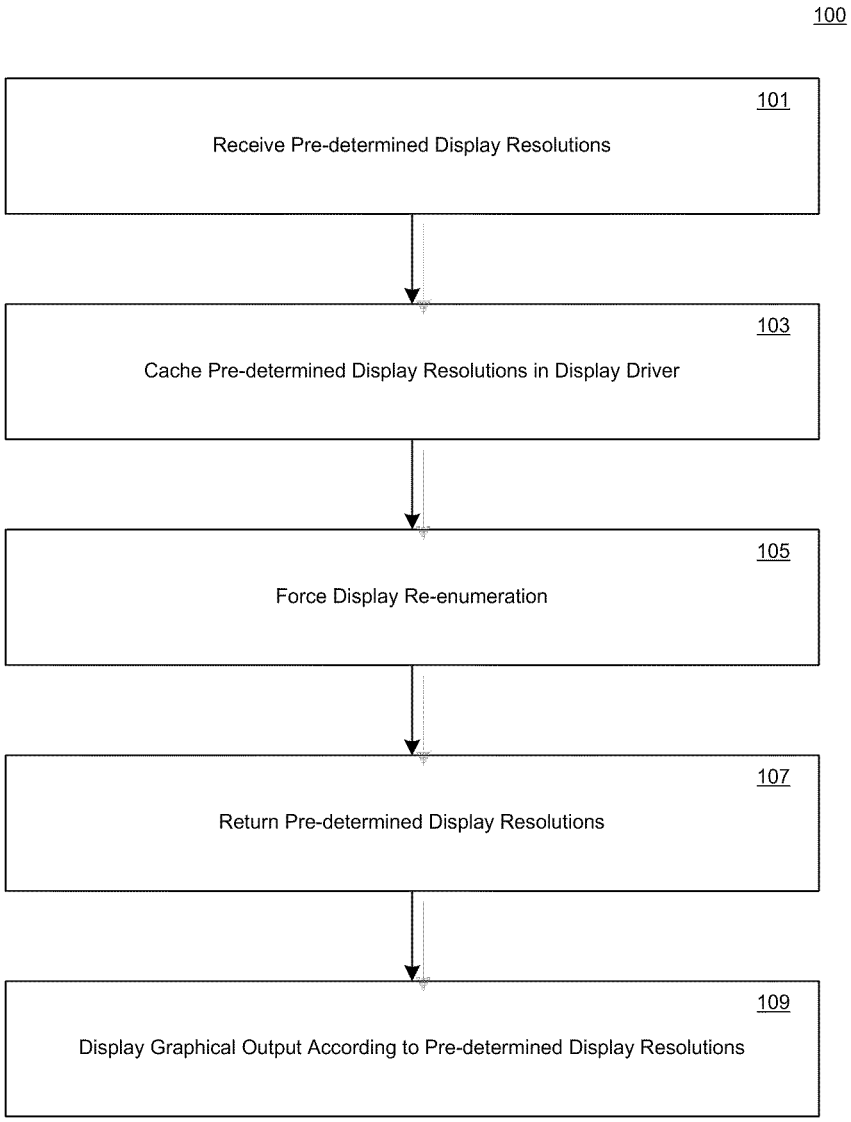
FIG. 1 depicts a flowchart of an exemplary method for limiting the display resolution in a display device for output of an application, in accordance with embodiments of the present invention.
Figure 2:
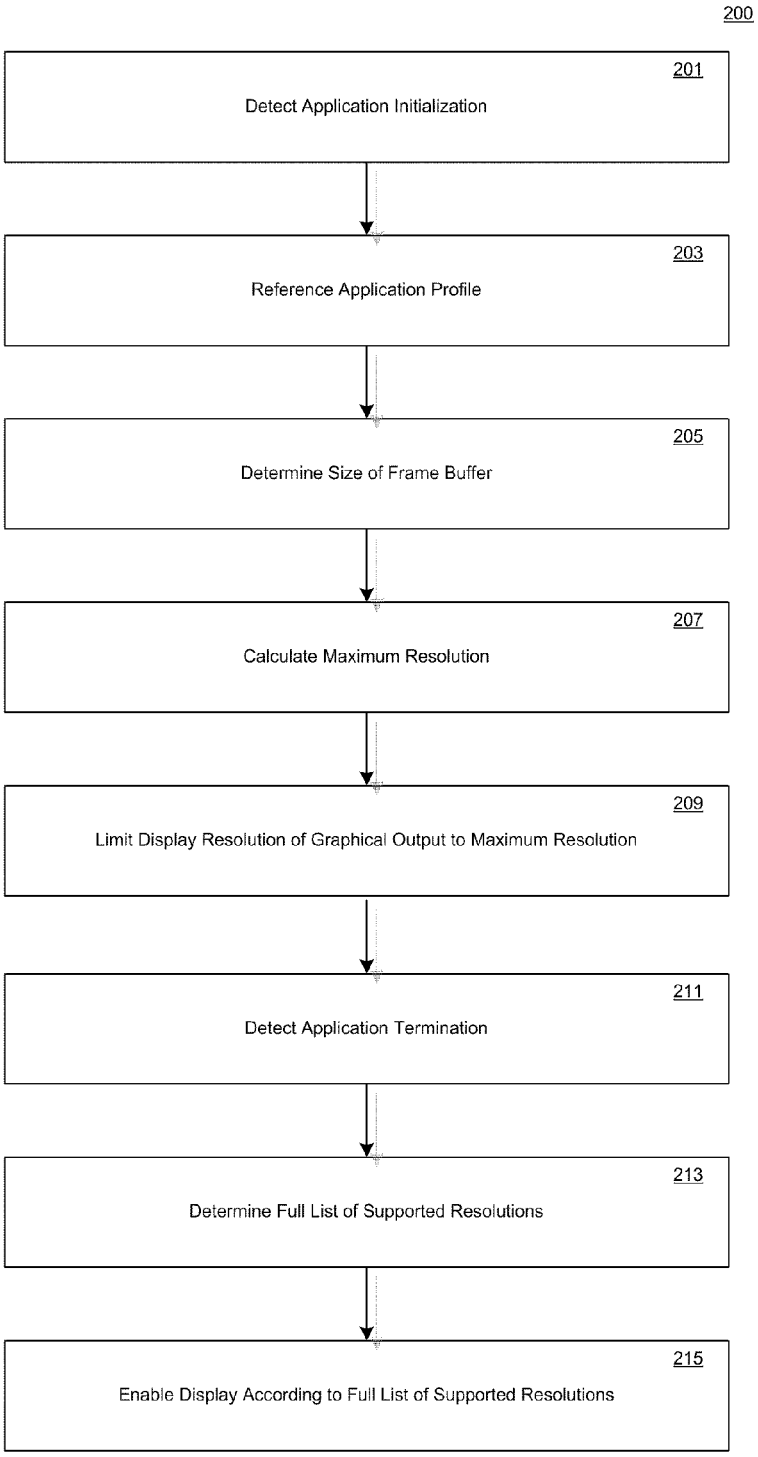
FIG. 2 depicts a flowchart of an exemplary method for determining an optimal display resolution for generating graphical output of an application in a graphics processing unit, in accordance with embodiments of the present invention.

Portions of the detailed description that follow are presented and discussed in terms of a process. Although steps and sequencing thereof are disclosed in figures herein (e.g., FIGS. 1 and 2) describing the operations of this process, such steps and sequencing are exemplary. Embodiments are well suited to performing various other steps or variations of the steps recited in the flowchart of the figure herein, that not all of the steps depicted may be performed, or that the steps may be performed in a sequence other than that depicted and described herein.

Some portions of the detailed description are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer-executed step, logic block, process, etc., is here, and generally, conceived to be a self-consistent sequence of steps or instructions leading to a desired result.

The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout, discussions utilizing terms such as "accessing," "writing," "including," "storing," "transmitting," "traversing," "associating," "identifying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Limiting Display Resolution

According to embodiments of the claimed subject matter, a method is provided for limiting the display resolution of graphical output in a computing system to achieve an optimal balance of performance and resolution given memory constraints of a graphics processing unit (e.g., a discrete GPU). According to typical graphics rendering processes, single units of images displayed to a user during a graphical sequence (e.g., a video) during the execution of an application are arranged as frames. Each frame is produced by sending graphics rendering instructions from the executing application to a command buffer of the GPU. The commands for rendering a frame are collected in a command buffer, and the instructions are delivered to the GPU to perform the requested operations. Once a frame has completed rendering, the GPU will store the data in one or more frame buffers until the frame is to be displayed in the display device. While the size of a GPU's frame buffers are static and comprised in its local memory, the size of the data contained in a rendered frame can vary widely, depending on the detail, size (e.g., resolution), and any features being included in the rendering of the frame.

Generally, the greater the resolution, the finer the details of a frame will be, and the greater the amount of space is available to display rendered objects. Naturally, a greater resolution also increases the size of a frame considerably; to the extent the size of the rendered frame may even limit the space remaining in the frame buffer of the GPU for other graphics resources. Often, a GPU's own local memory is supplemented with portions of the system memory which the GPU can use to temporarily store data as necessary. Thus, when the size of a frame consumes an excessive amount of the frame buffer, the remaining data corresponding to graphics resources may "spill" over and be stored in the system memory. The extra data is communicated (e.g., copied) to the system memory through the coupling communication bus (typically, the PCI-e bus). However, when accessing its own frame buffer, due to the position of the frame buffer in the GPU's local memory, access times (that is, the length of time it takes to read and write to the frame buffer) are very small. Unfortunately, the same does not necessarily hold true for accessing system memory. In particular, when the PCI-e interface is limited, as in single lane link architectures, due to the limited speed of data transfer rates, transferring the data between the memory of the GPU and system memory for each frame will add considerably to the overall graphics rendering process.

According to embodiments of the claimed subject matter, a computing system including one or more graphics processing units is provided. A user of the computing system may thus elect one of the graphics processing units to render the graphical output, corresponding to data produced by the computing system, which is then presented in a display device. In a typical embodiment, each of the graphics processing units interacts with the computing system through a driver operating in the computing system and each graphics processing unit has a specific, corresponding driver which communicates with the GPU through a bus in the computing system.

According to some embodiments, each of the graphics processing units may have specific (and possibly disparate) performance capabilities. These capabilities may be expressed as a plurality of characteristics that shape and configure the graphical output of the GPU as it is displayed by the display device. In a typical embodiment, these characteristics may include, but are not limited to, the resolution, pixel clock and bit depth of the output as displayed. In further embodiments, these characteristics are conveyed to the operating system executing on the computing system, whereupon they may be visible, selectable, and configurable by a user of the computing system.

The set of characteristics may be further organized by, for example, the operating system, into a plurality of discrete display modes. Each display mode may be collected and presented in a list of a graphical user interface (or other such arrangement) to the user, who is able to select one of the display modes to suit the user's needs or preferences. Generally, a user is able to select a display mode for the user interface of the operating system. This display mode is often maintained through the execution of many applications. In particular, applications with generally low graphical rendering intensities or needs. However, for applications with greater graphics processing needs, such as 3D gaming, a separate display mode may be selectable through the user interface of the application. This display mode can be different from the display mode of the operating system's user interface. When the application is presented in full display (e.g., is not windowed), the display will produce output according to the display mode selected for the application (which can be a default application).

In some embodiments, the selected display mode can be saved for the user, GPU, application, and/or display such that subsequent combinations of the user, the selected GPU, application, and/or the display device will cause the specific GPU to automatically produce graphical displays according to the display mode. Due to the disparity in performance capabilities and requirements, however, the list of display modes may not be consistent between all of the GPUs or for all of the applications in the system. That is, some display modes may not be offered by the drivers of a GPU as the display mode may exceed the capabilities of that GPU either generally, or for a specific application. Although multiple GPU systems are well suited to embodiments as described herein, for the purpose of brevity, unless otherwise specifically noted, usage of the term graphics processing unit, GPU, and corresponding features refer to the discrete graphics processing unit in a system. In particular, discrete graphics processing units with limited communication bandwidth with system memory.

Accordingly, the claimed subject matter is directed to a method for limiting the display resolution of graphical output in a computing system to achieve an optimal balance of performance and resolution given memory constraints. As presented in FIG. 1, a flowchart of an exemplary method 100 for automatically limiting the display resolution of output generated for an application by executing under specifically determined conditions is depicted, in accordance with embodiments of the present invention. Steps 101-109 describe exemplary steps comprising the method 100 in accordance with the various embodiments herein described.

In a typical application-rendering process, during an initialization of an application, the application will query the driver of the GPU performing graphics rendering operations for the application for a list of supported resolutions. However, the exported list of resolutions that are available to the application are not conventionally limited to the maximum performance that can be achieved by the GPU's memory alone. The exported list of resolutions seen by the application would include those resolutions that would leave sufficient space within the frame buffer such that other graphics resources could fit within the GPU's frame buffer as well as those resolutions that would produce frames of such size so as to render the remaining space in the frame buffer insufficient to store the graphics resources, requiring storage of those resources onto system memory. At step 101 of the method 100, a plurality of pre-determined settings is received for an application executing in a computing device.

In one embodiment, the plurality of pre-determined settings may comprise a plurality of display resolutions which are limited to producing frames of output that would allow graphics resources to fit in the frame buffers of the current operating GPU. In some embodiments, the plurality of ore-determined settings is received by accessing a profile in a knowledge base of pre-programmed profiles for a plurality of applications. In still further embodiments, the pre-programmed profiles are parsed and the profile for a specific initializing application is located in the knowledge base of pre-programmed profiles and the profile for the specific application is referenced to derive a data structure, such as a table, of empirically derived "optimal" display resolutions corresponding to the rendering of graphical output for the application in the specific GPU unit (or model).

As defined for the purposes of the claimed subject matter, the optimized display resolutions for rendering graphical output for the application in a specific GPU model comprises filtering the comprehensive list of GPU supported display resolutions to derive a selection of GPU supported display resolutions in which the size of the frames of graphical output generated for the application will still allow the storage of graphics resources within the frame buffer(s) of the GPU. In further embodiments, these optimal display resolutions account for additional features, such as anti-aliasing, which may increase or decrease the size of the rendered frame. In still further embodiments, a single optimal resolution is the maximum resolution in which frames of graphical output can be generated for the application that still allows the storage of graphics resources within the frame buffer(s) of the GPU.

At step 103, the plurality of pre-determined display resolutions received in step 101 are transmitted and cached in the display driver corresponding to the display device. At step 105, a display re-enumeration of the display driver is "forced" (that is, is explicitly induced) to receive a list of display resolutions supported by the display device. According to typical embodiments, a display re-enumeration re-calibrates the list of display resolutions supported by the system. However, a display driver is generally incapable of inducing a display re-enumeration by itself. Accordingly, in one embodiment, the display re-enumeration is induced by making an application programming interface (API) call from the application to the operating system. In further embodiments, a routine API call may be equipped with a flag which, when received by the operating system, prompts a display re-enumeration.

Once the display re-enumeration is induced at step 105, the pre-determined plurality of display settings received at step 101 is substituted for an actual comprehensive list of supported display resolutions and returned to the operating system as the list of supported display resolutions at step 107. In one embodiment, the list of supported display resolutions received at step 107 in the operating system may be thereafter presented to the user, who is prompted to select from the list of supported display resolutions. The display resolution selected by the user is then set and subsequently, the graphical output generated for the application by the GPU is rendered and displayed according to the user-selected display resolution. In alternate embodiments, a default display resolution may be automatically selected from the list of supported display resolutions without the need for user interaction. In still further embodiments, the default display resolution is automatically set to the highest resolution (e.g., optimal resolution) in the list of supported display resolutions.

By automatically filtering a list of supported display resolutions to the display resolutions which would not produce frames of graphical output of sufficient size the addition of graphics resources would exceed the size of the frame buffer, excessive rendering times of graphical output for an application may be pro-actively avoided due to the limited rates of data transfer available to systems with reduced communication bus capabilities. Accordingly, the efficiency of generating graphical output for applications in such systems may be advantageously improved.

Determining an Optimal Display Resolution

Accordingly, the claimed subject matter is directed to a method for determining an optimal display resolution to limit the display resolution of graphical output in a computing system to achieve an optimal balance of performance and resolution given memory constraints. As presented in FIG. 2, a flowchart of an exemplary method 200 for automatically determining an optimal display resolution of output generated for an application by executing under specifically determined conditions is depicted, in accordance with embodiments of the present invention. Steps 201-215 describe exemplary steps comprising the method 200 in accordance with the various embodiments herein described.

At step 201, an initialization of an application executing in a computing device is detected. Detecting the initialization of the application may comprise, for example, detecting the initialization of the application in the operating system of the computing device. In response to the detecting the initialization of the application, a profile corresponding to the application whose initialization is detected in 201 is referenced to determine the memory usage required by graphical output of the application. In one embodiment, the profile is specific to the application and stored in a plurality of profiles corresponding to a plurality of applications. In still further embodiments, the memory usage requirements for an application comprise the memory required to generate frames of graphical output according to a plurality of display resolutions and enabled features (e.g., anti-aliasing). According to one embodiment, the memory usage requirements may be pre-determined empirically and recorded in the profile as part of, or pre-packaged with, the software containing the driver(s) corresponding to the graphics processing unit. In still further embodiments, the data for determining memory usage of an application is stored within tables or like data structures in the profile corresponding to the application.

At step 205, the graphics memory, that is, the memory disposed on the video card comprising the discrete graphics processing unit of embodiments discussed herein is queried to determine the size of the one or more frame buffers of the GPU subsystem. At step 207, a maximum resolution for graphical output of the application whose initialization was detected in step 201 is calculated based on the memory usage determined in step 203 and the size of the frame buffer(s) determined in step 205. In one embodiment, calculating the maximum resolution may comprise determining the highest resolution (including enabled features) whose memory usage (including other graphics resources) does not exceed the size of the frame buffer. At step 209, the display resolutions that are greater than the maximum resolution determined at step 205 are removed from the list of supported resolutions. According to some embodiments, the maximum resolution derived at step 205 is automatically set as the resolution for graphical output produced for the application during the application's execution. In alternate embodiments, the user is presented a new list of resolutions that are supported by the GPU and do not exceed the maximum resolution derived at step 205. The user may subsequently select from the new list of resolutions which will produce output that does not require storage in system memory.

At step 211, termination of the application initiated in step 201 is detected. Once the application's termination is detected, the driver of the graphics processing unit is queried to determine a full list of supported resolutions at step 213. In typical embodiments, these resolutions correspond to the supported resolutions in which the user interface of the operating system and other currently executing applications may be displayed in. Typically, for non 3D gaming applications, these resolutions may exceed the maximum resolution determined in step 205 for the application but, because of their reduced memory requirements, would not require storing textures and other resources in the system memory. Finally, at step 215, the display of the user interface of the operating system (and other applicable, executing applications) is enabled to display according to the resolutions included in the entire list of supported resolutions determined at step 213. In one embodiment, the actual resolution in which the user interface of the operating system is presented is the same resolution that was used prior to executing the application initialized in step 201. According to these embodiments, the user is also able to alter the display resolution to any resolution comprised in the list of supported resolutions.

By automatically determining an optimal resolution to display rendered graphical output, resolutions may be determined for a process of limiting frame rates which would not produce frames of graphical output of sufficient size to exceed the size of the frame buffer. Accordingly, the benefits of avoiding excessive rendering times of graphical output for an application due to the limited rates of data transfer available to systems with reduced communication bus capabilities and improving the efficiency of generating graphical output for applications in such systems as described above may be enabled and/or extended.

Data Flow Chart

Figure 3:
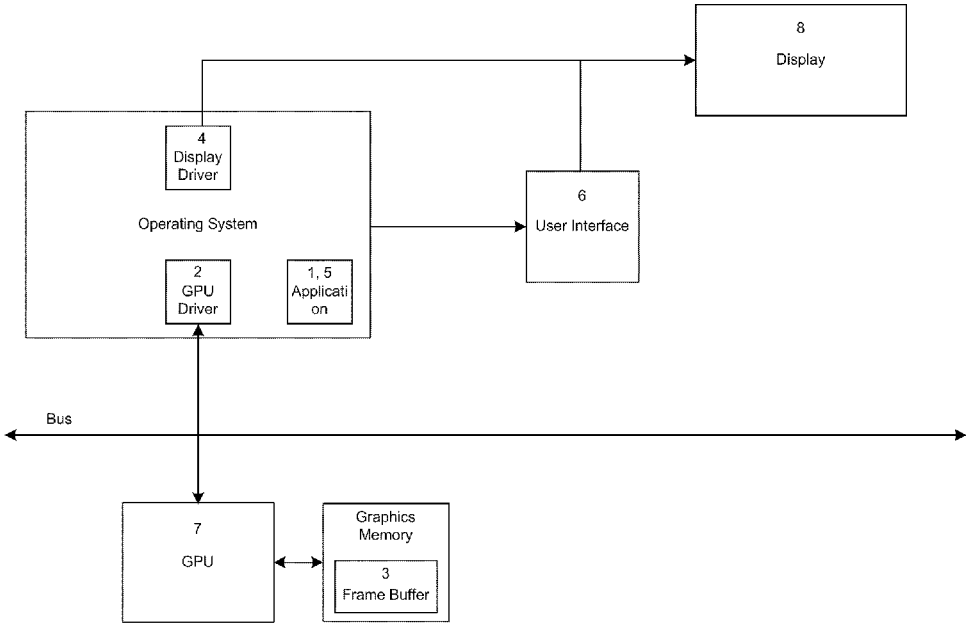
FIG. 3 depicts a block diagram exhibiting the flow of data in an exemplary computing system, in accordance with embodiments of the present invention.

With reference now to FIG. 3, a data flow chart 300 of an exemplary system performing a method for limiting display resolution is depicted, in accordance with one embodiment. In a typical configuration, an application is initialized in an operating system (1). Once the application's execution is detected, the driver of the GPU performing the processing for rendered output is queried for a list of supported display resolutions (2). In one embodiment, the driver of the GPU may access a plurality of pre-programmed application profiles and select a profile corresponding to the executing application to determine the list of supported display resolutions. As described above, the list of supported display resolutions may be optimized to remove the display resolutions that would produce excessively large frames that would prohibit the storage of textures and other graphics resources in the frame buffers of the GPU. In still further embodiments, the driver of the GPU may access an application's profile to determine the memory usage requirements for the applications, including any enabled features.

In some embodiments, the frame buffer of the particular GPU may be queried to determine the size of the frame buffer (3). According to these embodiments, the maximum optimal resolution may be calculated from the size of the frame buffer and the memory usage requirements. Once the plurality of optimal supported display resolutions is determined, the list of the optimal supported display resolutions is cached in the driver of the display device (4). An API call is made from the application (5) to induce a display re-enumeration. In some embodiments, the list of display resolutions may be presented in the user interface (6), enabling the user to select from the list of display resolutions for graphical output of the application to be presented. Thereafter, graphical output of the application is rendered in the GPU (7) according to the display resolution selected in the user interface or automatically set according to the maximum optimal resolution. Once the graphical output is rendered, the frames are displayed in the display device (7) of the system.

Exemplary Computing Device

Figure 4:
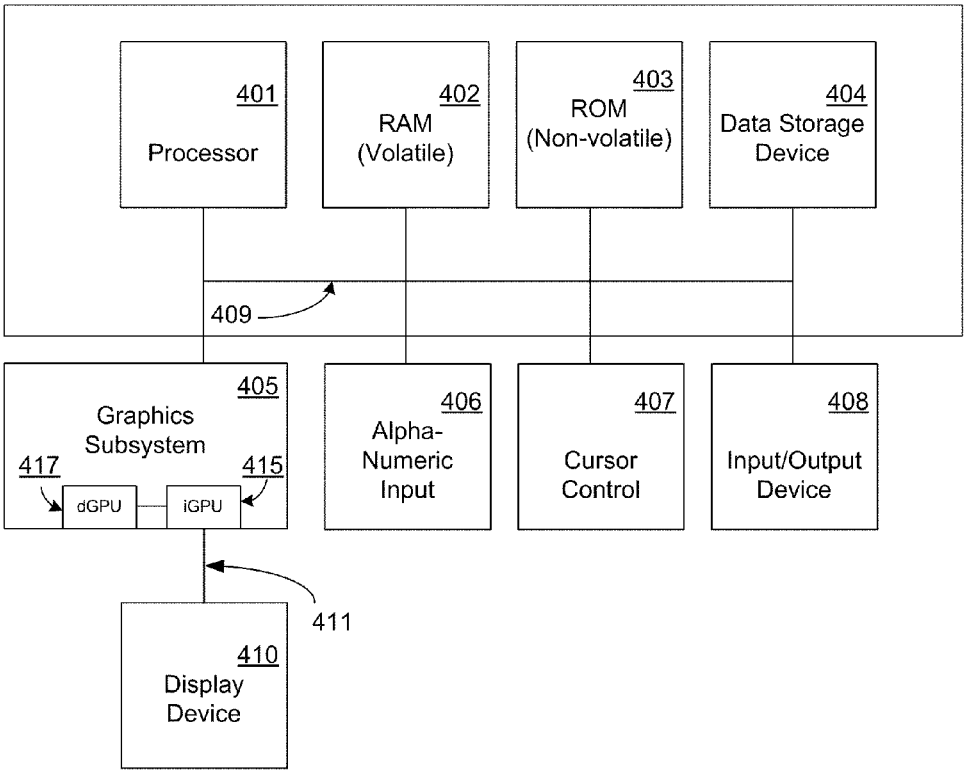
FIG. 4 depicts an exemplary computing environment, in accordance with embodiments of the present invention.

As presented in FIG. 4, an exemplary system upon which embodiments of the present invention may be implemented includes a general purpose computing system environment, such as computing system 400. In its most basic configuration, computing system 400 typically includes at least one processing unit 401 and memory, and an address/data bus 409 (or other interface) for communicating information. Depending on the exact configuration and type of computing system environment, memory may be volatile (such as RAM 402), non-volatile (such as ROM 403, flash memory, etc.) or some combination of the two.

Computer system 400 may also comprise an optional graphics subsystem 405 for presenting information to the computer user, e.g., by displaying information on an attached display device 410, connected by a video cable 411. According to embodiments of the present claimed invention, the graphics subsystem 405 may include an integrated graphics processing unit (e.g., iGPU 415) coupled directly to the display device 410 through the video cable 411 and also coupled to a discrete graphics processing unit (e.g., dGPU 417). According to some embodiments, rendered image data may be communicated directly between the graphics processing units (e.g., iGPU 415 and dGPU 417) via a communication bus 409 (e.g., a PCI-e interface). Alternatively, information may be copied directly into system memory (RAM 402) to and from the graphics processing units (e.g., iGPU 415 and dGPU 417) also through the communication bus 409. In alternate embodiments, display device 410 may be integrated into the computing system (e.g., a laptop or netbook display panel) and will not require a video cable 411. In one embodiment, the processes 100 and 200 may be performed, in whole or in part, by graphics subsystem 405 in conjunction with the processor 401 and memory 402, with any resulting output displayed in attached display device 410.

Additionally, computing system 400 may also have additional features/functionality. For example, computing system 400 may also include additional storage (removable and/or non-removable) including, but not limited to, magnetic or optical disks or tape. Such additional storage is illustrated in FIG. 4 by data storage device 404. Computer storage media includes volatile and nonvolatile, removable and non-removable media implemented in any method or technology for storage of information such as computer readable instructions, data structures, program modules or other data. RAM 402, ROM 403, and data storage device 404 are all examples of computer storage media.

Computer system 400 also comprises an optional alphanumeric input device 406, an optional cursor control or directing device 407, and one or more signal communication interfaces (input/output devices, e.g., a network interface card) 408. Optional alphanumeric input device 406 can communicate information and command selections to central processor 401. Optional cursor control or directing device 407 is coupled to bus 409 for communicating user input information and command selections to central processor 401. Signal communication interface (input/output device) 408, also coupled to bus 409, can be a serial port. Communication interface 409 may also include wireless communication mechanisms. Using communication interface 409, computer system 400 can be communicatively coupled to other computer systems over a communication network such as the Internet or an intranet (e.g., a local area network), or can receive data (e.g., a digital television signal).

Although the subject matter has been described in language specific to structural features and/or processological acts, it is to be understood that the subject matter defined in the appended claims is not necessarily limited to the specific features or acts described above. Rather, the specific features and acts described above are disclosed as example forms of implementing the claims.

What is claimed is:

1. A method for limiting a display resolution of an application executing in a discrete graphics processing unit (GPU) in a computing device, the method comprising:

in response to an initialization of the application with graphical output generated by the discrete GPU, referencing a profile corresponding to the application from a plurality of profiles corresponding to a plurality of applications to determine a memory usage required by the graphical output of the application;

querying a memory of the discrete GPU to determine a size of a frame buffer of the discrete GPU;

calculating, based on the memory usage, a maximum resolution for graphical output of the application generated by the discrete GPU to prevent graphics resources from being transferred to and be stored in a main memory of the computing device, wherein the memory usage includes storage space for graphics resources that comprise a plurality of graphical textures, wherein the memory usage does not exceed the size of the frame buffer;

filtering a first plurality of display resolutions to remove display resolutions that would cause the memory usage of the application to exceed the size of the frame buffer;

caching the filtered first plurality of display resolutions in a display driver corresponding to a display device of the computing device;

forcing a first display re-enumeration of the display driver in response to an API call from the application while executing the application in the computing device to an operating system of the computing device to receive a list of resolutions supported by the display device;

in response to the first display re-enumeration, replacing the list of resolutions supported by the display device with the filtered first plurality of display resolutions that does not exceed the maximum resolution; and displaying graphical output corresponding to the application on the display device according to a first display resolution of the filtered first plurality of display resolutions, wherein a user is not able to select a resolution of graphical output for the application that exceeds the maximum resolution.

2. The method according to claim 1, wherein the calculating, the filtering, the caching, the forcing, and the replacing are performed dynamically in response to a detecting an initializing of an execution of the application in the computing device.

3. The method according to claim 2, further comprising:

detecting a termination of the execution of the application in the computing device;

forcing a second display re-enumeration of the display driver to receive a plurality of supported display settings;

in response to the second display re-enumeration, querying the driver of the discrete GPU to determine a second plurality of display resolutions supported by the discrete GPU; and returning the second plurality of display resolutions as the list of resolutions supported by the display device, wherein the list of display resolutions is supported by the display device is supported by the discrete GPU irrespective of the application.

4. The method according to claim 1, wherein the filtering the first plurality of display resolutions comprises:

accessing the profile corresponding to the application from the plurality of profiles; and parsing the profile to derive memory usage requirements corresponding to the application.

5. The method according to claim 4, wherein the memory usage requirements corresponding to the application is stored in a data structure comprised in the profile corresponding to the application.

6. The method according to claim 5, wherein the data structure is a table.

7. The method according to claim 1, wherein the first plurality of display resolutions comprises a selection of resolutions from the plurality of supported display resolutions.

8. The method according to claim 1, wherein the first plurality of display resolutions comprises the maximum resolution in which a frame of graphical output is able to be rendered by the discrete GPU and, when stored with a plurality of graphical textures in the frame buffer comprised in the memory of the discrete GPU, will not exceed a size of the frame buffer.

9. The method according to claim 8, wherein graphical output corresponding to the application is displayed in the display device at a resolution which does not exceed the maximum resolution.

10. The method according to claim 1, wherein the forcing a display re-enumeration of the display driver is performed by an operating system executing on the computing device.

11. The method according to claim 10, wherein the forcing a display re-enumeration comprises:

making an application programming interface (API) call to an operating system executing on the computing device, wherein the API call comprises a flag; and querying the display driver for the first plurality of display resolutions in response to receiving the API call comprising the flag.

12. The method of claim 1, further comprising:

presenting the first plurality of display resolutions to a user of the system;

prompting the user for a selection of a display resolution from the first plurality of display resolutions;

receiving the selection of the display resolution; and setting the first display resolution to the selection.

13. A system for limiting a display resolution of an application executing in a discrete graphics processing unit (GPU) of a computing device, the system comprising:

the discrete GPU for rendering graphical output;

a display device communicatively coupled to the discrete GPU for displaying the graphical output;

a graphics memory communicatively coupled to the discrete GPU, the graphics memory comprising a frame buffer;

a processor of the computing device, coupled to a main memory of the computing device, for executing an operating system;

a plurality of device drivers, comprised in the operating system, including a display driver corresponding to the display device and a graphics driver corresponding to the discrete GPU; and a plurality of applications including the application hosted on the operating system, wherein in response to an initialization of the application of the plurality of applications, an API call is generated from the application to the operating system of the computing device, a display re-enumeration of the display driver is forced in response to the API call, a list of resolutions supported by the display device is received in response to the display re-enumeration, and the list of resolutions supported by the display device is replaced with a filtered first plurality of display resolutions that does not exceed a maximum resolution for graphical output of the application, wherein the filtered first plurality of display resolutions is calculated by determining a size of the frame buffer for the graphics memory by querying the graphics memory and referencing a profile corresponding to the application from a plurality of profiles corresponding to a plurality of applications to determine a memory usage required by graphical output of the application, and by removing display resolutions that would cause the memory usage of the application to exceed the size of the frame buffer, wherein the memory usage includes storage space for graphics resources that comprise a plurality of graphical textures;

wherein the maximum resolution is calculated such that graphics resources generated by the discrete GPU as graphical output of the application is prevented from being transferred to and be stored in the main memory of the computing device, further wherein a user is not able to select a resolution of graphical output of the application that exceeds the maximum resolution.

14. The system according to claim 13, wherein the discrete GPU is substantially compliant with PCI-e interface standard.

15. The system according to claim 14, wherein the discrete GPU is communicatively coupled to the processor via a PCI-e interface.

16. A method for limiting resolution of an application executing in a discrete graphics processing unit (GPU) of a computing device, the method comprising:

in the computing device comprising the discrete GPU comprising a graphics memory, detecting an initialization of the application in response to the detecting the initialization of the application, referencing a profile corresponding to the application from a plurality of profiles corresponding to a plurality of applications to determine a memory usage required by graphical output of the application;

querying the graphics memory to determine a size of a frame buffer corresponding to the graphics memory;

calculating, based on the memory usage, a maximum resolution for graphical output of the application generated by the discrete GPU to prevent graphics resources from being transferred to and be stored in a main memory of the computing device, wherein the memory usage includes storage space for the graphics resources that comprise a plurality of graphical textures, and wherein the memory usage does not exceed the size of the frame buffer;

filtering a list of supported display resolutions to remove display resolutions that would cause the memory usage of the application to exceed the size of the frame buffer; and limiting the display resolution of graphical output corresponding to the application in a display device to a resolution no greater than the maximum resolution, wherein calculating the maximum resolution for graphical output comprises receiving an API call from the application executing to an operating system of the computing device and forcing a re-enumeration of a plurality of resolutions supported by the display device in response thereto, further wherein a user is not able to select a resolution of graphical output of the application that exceeds the maximum resolution.

17. The method according to claim 16, further comprising:

detecting a termination of an application executing in the computing device;

in response to the detecting the termination of the application, querying the display device to determine a full list of resolutions supported by the display device; and allowing the display resolution of graphical output displayed in the display device to be any resolution of the full list of resolutions supported by the display device.

* * * * *